US007703534B2

(12) United States Patent
Sheshtawy

(10) Patent No.: US 7,703,534 B2
(45) Date of Patent: Apr. 27, 2010

(54) UNDERWATER SEAFLOOR DRILLING RIG

(76) Inventor: Adel Sheshtawy, 11706 Highgrove Dr., Houston, TX (US) 77077

( * ) Notice: Subject to any disclaimer, the term of this patent is extended or adjusted under 35 U.S.C. 154(b) by 337 days.

(21) Appl. No.: 11/583,562

(22) Filed: Oct. 19, 2006

(65) Prior Publication Data

US 2008/0093082 A1 Apr. 24, 2008

(51) Int. Cl.
*E21B 7/12* (2006.01)

(52) U.S. Cl. ..... 166/358; 166/356; 166/302; 166/57; 175/5; 175/6

(58) Field of Classification Search ..... 166/358, 166/356, 339, 350, 57, 61, 302; 175/5–10
See application file for complete search history.

(56) References Cited

U.S. PATENT DOCUMENTS 3,063,507 A 11/1962 O'Neill et al.
3,504,740 A 4/1970 Manning
3,552,903 A 1/1971 Townsend, Jr.
3,556,208 A 1/1971 Dean
3,602,301 A 8/1971 James
3,638,720 A 2/1972 Thomas
3,642,063 A 2/1972 Jergins
3,643,736 A 2/1972 Talley, Jr.
3,656,549 A 4/1972 Holbert, Jr. et at
3,661,204 A * 5/1972 Blanding et al. ..... 166/356
3,709,307 A * 1/1973 Clark ..... 175/8
3,741,320 A * 6/1973 Hilfing ..... 175/6
3,855,806 A 12/1974 Le Therisien
3,902,553 A * 9/1975 Jergins ..... 166/352
4,043,407 A * 8/1977 Wilkins ..... 175/50
4,054,104 A * 10/1977 Haselton ..... 114/264
4,149,818 A 4/1979 Hettinger et al.
4,255,068 A * 3/1981 Valantin ..... 405/195.1
4,913,590 A * 4/1990 Svenning et al. ..... 405/188
5,098,219 A * 3/1992 Harrington et al. ..... 405/8
5,400,735 A 3/1995 Yamin et al.
5,775,844 A * 7/1998 Nelson ..... 405/188
6,394,192 B1 * 5/2002 Frazer ..... 175/58

(Continued)

FOREIGN PATENT DOCUMENTS

WO WO 03093625 A2 11/2003
WO WO 03093625 A3 11/2003

*Primary Examiner*—Thomas A Beach
*Assistant Examiner*—Matthew R Buck
(74) *Attorney, Agent, or Firm*—John G. Fischer, Esq.; Mark D. Perdue, Esq.; Storm LLP

(57) ABSTRACT

A subsea drilling system comprises a pressurized drilling capsule that is sealed against the subsea environment and houses equipment for manipulating a drillstring that extends through an opening in the drilling capsule to the exterior of the capsule. A drilling fluid handling assembly is contained within the drilling capsule that communicates drilling fluid through the drillstring and returns the drilling fluid to the water's surface via a drilling fluid conduit. A seafloor unit engages the seafloor and the drilling capsule to position the drilling capsule relative to the seafloor, and includes an opening for passing the drillstring into the seafloor. A pressurized transport unit is movable between the drilling capsule and a support vessel at or near the water's surface for delivering personnel and supplies to the drilling capsule. A method of drilling using the subsea drilling system is disclosed.

21 Claims, 9 Drawing Sheets

U.S. PATENT DOCUMENTS 6,808,021 B2 10/2004 Zimmerman et al.
7,380,614 B1 * 6/2008 Williamson et al. ..... 175/6
2005/0109537 A1 * 5/2005 Ayling ..... 175/5
2006/0016621 A1 * 1/2006 Jackson et al. ..... 175/7

* cited by examiner

UNDERWATER SEAFLOOR DRILLING RIG

BACKGROUND OF THE INVENTION

1. Field of the Invention

The present invention relates generally to offshore or subsea drilling systems or rigs. More particularly, the present invention relates to submersible systems for deepwater drilling for hydrocarbons or other natural resources.

2. Summary of the Prior Art

Drilling for hydrocarbons (oil and natural gas) offshore, in some instances hundreds of miles away from the nearest landmass, poses a number of different challenges over drilling onshore. The actual drilling mechanism used to delve into the seafloor often is much the same as can be found on an onshore rig. However, with drilling at sea, the seafloor can sometimes be thousands of feet below water level. Thus, while with onshore drilling the ground provides a very large load carrying capacity platform from which to drill, at sea, an artificial drilling platform with the same load carrying capacity must be constructed to support the offshore drilling equipment.

Drilling offshore dates back as early as 1869, when a T. F. Rowland developed an offshore drilling rig design. The rig was designed to operate in very shallow water, but the seafloor-anchored, four-legged tower bears much resemblance to a land drilling rig and modern offshore rigs, with the drilling platform at the water level instead of resting on the ground. It wasn't until after World War II that the first truly offshore well was drilled in the Gulf of Mexico. Since then, offshore production, particularly in the Gulf of Mexico, has been very successful, with the discovery and development of a great number of large oil and gas deposits.

There are two basic types of offshore drilling rigs: those that can be moved from place to place, allowing for drilling in multiple locations, and those that are permanently placed. Movable rigs are often used for exploratory purposes because they are much less expensive to use than permanent platforms. Once large deposits of hydrocarbons have been found, a permanent platform is built to allow their extraction. There are a number of different types of movable offshore rigs. These include drilling barges and ships, jack-up rigs, submersible rigs, submersible rigs, and semi-submersible rigs.

Drilling barge rigs are used mostly for inland, shallow water drilling. This typically takes place in lakes, swamps, rivers, and canals. Drilling barges are large, floating platforms, which must be towed by tugboat from location to location. Suitable for still, shallow waters, drilling barges are not able to withstand the water movement experienced in large open water environments.

Drillships are exactly as they sound: ships designed to carry out drilling operations. These drillships are specially designed to carry drilling platforms out to deep-sea locations. A typical drillship will have, in addition to all of the equipment normally found on a large ocean ship, a drilling platform and derrick located on the middle of its deck. In addition, drillships contain a hole (or "moonpool"), extending right through the ship down through the hull, which allows for the drillstring to extend through the boat, down into the water. Drillships are often used to drill in very deep water, which can often be quite turbulent. Drillships also use dynamic positioning systems. Drillships are equipped with electric motors with propellers on the underside of the ship's hull, capable of propelling the ship in any direction. These motors are integrated into the ship's computer system, which uses satellite positioning technology, in conjunction with sensors located on the drilling template at the sea bottom, to ensure that the ship is directly above the drill site at all times.

Jack-up rigs are similar to drilling barges, with one difference. Once a jack-up rig is towed to the drilling site, three or four "legs" are lowered until they rest on the sea bottom. This allows the working platform to rest above the surface of the water, as opposed to simply floating. However, jack-up rigs are suitable only for shallow waters (approximately 450 feet), as extending the legs down too deeply would be impractical. These rigs are typically safer to operate than drilling barges, as their working platform is elevated above the sea water level.

Submersible rigs, also suitable for shallow water, are like jack-up rigs in that they come in contact with the ocean or lake floor. These rigs typically consist of platforms with two hulls positioned on top of one another. The upper hull contains the living quarters for the crew, as well as the actual drilling platform. The lower hull works much like the outer hull in a submarine—when the platform is being moved from one place to another, the lower hull is filled with air—making the entire rig buoyant. When the rig is positioned over the drill site, the air is let out of the lower hull, and the rig's lower hull submerses to the sea or lake floor. This type of rig has the advantage of mobility in water, however, once again, its use is limited to shallow water areas.

Semi-submersible rigs are the most common type of deep water offshore drilling rigs, combining the advantages of submersible rigs with the ability to drill in deep water. Semi-submersible rigs work on the same principle as submersible rigs; through the "inflating" and "deflating" of its lower hull. The main difference with a semi-submersible rig, however, is that when the air is let out of the lower hull, the rig's lower hull does not submerge to the seafloor. Instead, the rig is partially submerged, but still floats above the drill site. When drilling, the lower hull, filled with water, provides stability to the rig. Semi-submersible rigs are held in place by huge anchors, each weighing upwards of ten tons. These anchors, combined with the submerged portion of the rig, ensure that the platform is stable and safe enough to be used in turbulent offshore waters. Semi-submersible rigs can be used to drill in much deeper water than the rigs mentioned above. Semi-submersible rigs can be used for drilling in very deep water by replacing the anchors with multi-computer controlled propellers which are commonly known as a "dynamic positioning system."

The oil and gas industry in its search for additional hydrocarbon reserves in deep water currently utilizes drillships or semi-submersible drilling units. These are generally called "floating" drilling units and they have a riser (a large-diameter pipe) connecting the floating drilling unit to the BOP stack and template at the sea bottom or floor. The water depth limitation of the current deep water drilling method is approximately 10,000 feet for several reasons:

1. The effect of the long column of drilling fluid (mud) in the riser on the subsea shallow unconsolidated formation integrity.
2. The maximum riser weight the floating drilling unit can support.
3. The ability to maintain the floating drilling unit within a very limited radius above the subsea well location, especially under high current and waves.

The latest generations of the floating drilling units are several thousand tons variable load capacity and cost up to $500,000 per day rental and these floating drilling units are currently in a very short supply.

Therefore, a need exists for a submersible drilling rig or system adapted for deepwater drilling that eliminates the need for a long riser and the associated difficulties presented in position-keeping, as well as avoiding the skyrocketing cost and limited availability of deep water floating drilling units.

SUMMARY OF THE INVENTION

It is a general object of the present invention to provide an improved offshore drilling assembly of the submersible type. This and other objects of the present invention are achieved by providing a subsea drilling system comprising a pressurized drilling capsule that is sealed against the subsea environment and houses equipment for manipulating a drillstring that extends through an opening in the drilling capsule to the exterior of the capsule. A drilling fluid handling assembly is contained within the drilling capsule which communicates drilling fluid through the drillstring and returns the drilling fluid to the water's surface via a drilling fluid conduit. A seafloor unit engages the seafloor and the drilling capsule to position the drilling capsule relative to the seafloor, and includes an opening for passing the drillstring into the seafloor. A pressurized transport unit is movable between the drilling capsule and a support vessel at or near the water's surface for delivering personnel and supplies to the drilling capsule.

According to the preferred embodiment of the present invention, the drilling capsule is an elongate pressure vessel having an opening at one end for connection to the equipment and personnel transport units, and an opening at an opposing end through which the drillstring passes.

According to the preferred embodiment of the present invention, the equipment for manipulating a drillstring includes a top drive mounted to a mast by a rack-and-pinion.

According to the preferred embodiment of the present invention, the seafloor unit comprises a generally flat guided legs template having the opening and having wire guiding lines extending from the template to the water's surface. A plurality of leveling legs extends upward from the template to engage a lower surface of the drilling capsule. A tubular member extends from the opening in the guided legs template, the opening and tubular member cooperate to receive the drillstring and guide it into the formation to be drilled.

According to the preferred embodiment of the present invention, a plurality of buoyancy capsules are secured to the drilling capsule. The buoyancy capsules have adjustable buoyancy so that the drilling capsule can selectively float, sink, or have neutral buoyancy.

According to the preferred embodiment of the present invention, a pressurized emergency personnel capsule is associated with the drilling capsule to permit human personnel to exit the drilling capsule in an emergency.

According to the preferred embodiment of the present invention, the drilling capsule is of sufficient length to handle at least one section of conventional, 30-foot drill pipe.

According to the preferred embodiment of the present invention, the drilling capsule is a pressure vessel of double-wall construction having an inner and an outer wall. The space between the inner and outer walls is selectively pressurized.

In another aspect of the present invention, an improved method of drilling a formation under the water is achieved by pressurizing a drilling capsule assembly and maintaining the drilling capsule assembly in a pressurized state suitable for human occupancy. The drilling capsule assembly is submerged by altering its buoyancy. The drilling capsule assembly is secured to the formation by drilling a pilot hole in the formation from within the drilling capsule assembly and by inserting a portion of the drilling capsule assembly into the pilot hole, specifically the surface casing. A drillstring is delivered to the drilling capsule assembly, the drillstring including at least one length of 30-foot drillpipe. A bottom-hole assembly is made up into the drillstring and rotated from within the drilling capsule to bore a hole in the formation. The drillstring is selectively removed from the hole and the drilling capsule assembly, wherein the drillstring remains assembled and includes at least one length of 30-foot drill pipe, and preferably several lengths.

Other objects, features, and advantages of the present invention will become apparent with reference to the figures and the detailed description of the invention, which follow.

DETAILED DESCRIPTION

Referring now to the Figures and particularly to FIGS. 1A through 1C, 2 and 3, an Underwater Seafloor Drilling Rig (USDR) or system 11 according to the present invention is depicted in a submarine environment. This environment, which is referred to as "undersea" or "sub-sea," can be any underwater environment in which there is a floor or seafloor 3 and a water surface 1. Such subterranean environments include freshwater seas and lakes, as well as offshore oceanic environments.

USDR 11 comprises a drilling capsule 101 which is a steel pressure vessel of multi-wall constructions that is designed to withstand pressures encountered in the undersea environment. Drilling capsule 101 is filled with a continuous supply of air or appropriate human-breathable gas at equivalent atmospheric pressure to provide a safe environment for the operating crew of the USDR 11 and to help withstand the hydrostatic pressure exerted on the outer walls of drilling capsule 101. Preferably, drilling capsule 101 has an outer diameter of 19.5 feet and a length of 89 feet. It is of steel (AISI 4340 heat-treated alloy with a yield strength of 140 ksi), with double-wall construction. A two-inch "dead space" between the inner and outer hulls is pressurized with an inert gas to assist in equalizing the pressure between the atmospheric interior pressure and the primarily hydrostatic pressure on the exterior of the capsule.

Figure 2:
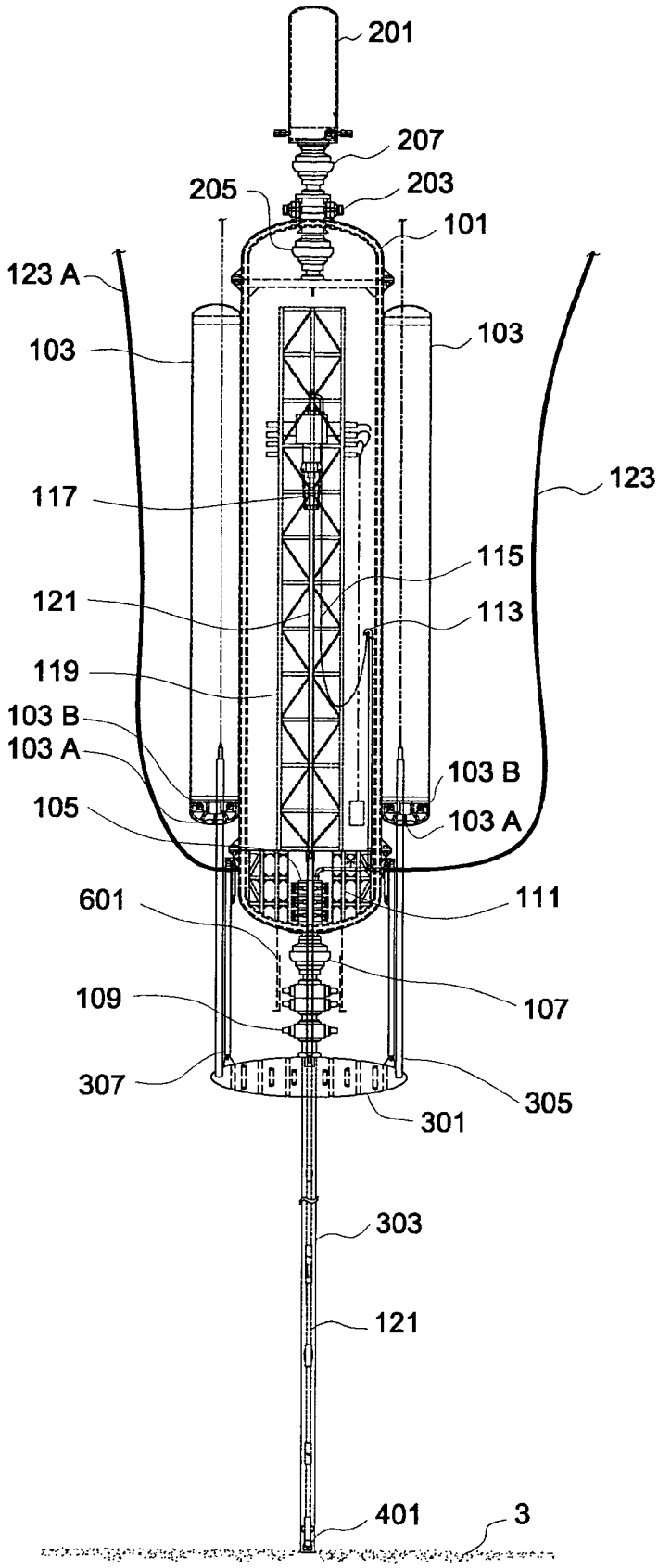
FIG. 2 is a longitudinal section view of the drilling capsule assembly at neutral buoyancy with the sealed end of the surface casing just penetrating the soft seafloor.
Figure 3:
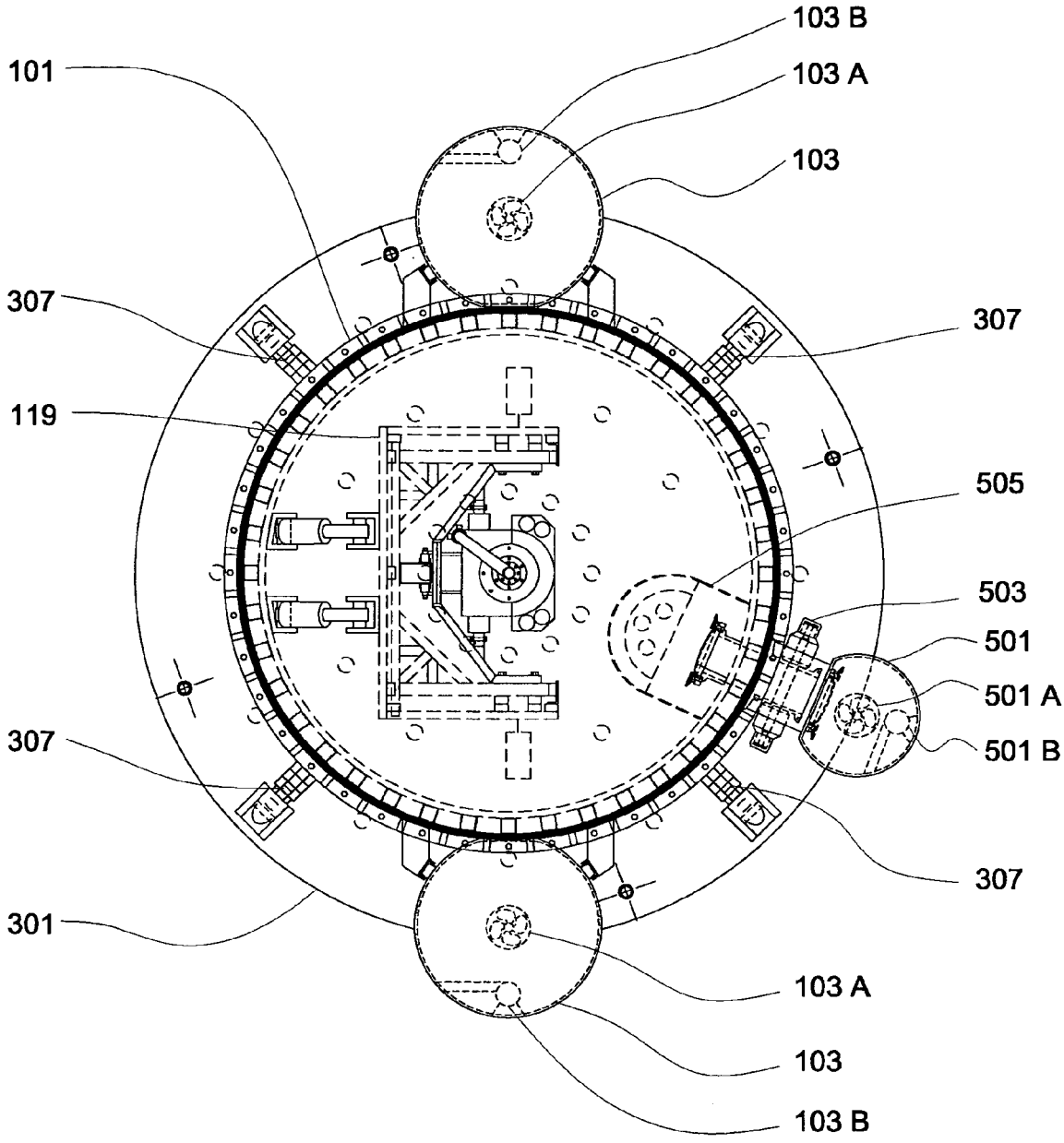
FIG. 3 is a cross-section view of the drilling capsule assembly showing the interior arrangement of the drilling capsule in an operating compartment.

As best seen in FIGS. 2 and 3, a plurality or pair of buoyancy capsules 103 is secured to the exterior of drilling capsule 101. Buoyancy capsules 103 can be selectively filled with air (or other gases) or water (or other liquids) via pumps 103B to alter the buoyancy of the assembled buoyancy capsules 103 and drilling capsule 101 so that the assembly may have positive, negative, or neutral buoyancy, as the situation requires. Buoyancy capsules are provided at their lower end with thrusters (propellers or jets) 103A to provide steerability of the drilling capsule assembly 101, 103. Drilling capsule 101 and buoyancy capsules 103 together comprise a drilling capable assembly.

At the lower end of drilling capsule 101, there is an aperture or opening provided with a watertight hatch 105 that permits tubular members, such as drill pipes or casings, to exit the lower end of drilling capsule 101. A series or stack of conventional spherical and ram blowout preventers (BOP) 107 are secured to the lower end of hatch 105 to provide a water- and pressure-resistant seal while allowing drilling equipment to pass through them.

Also at the lower end of drilling capsule 101, but contained within the atmospheric pressure of drilling capsule 101, a closed, continuous drilling fluid (mud) circulation system 111 is provided. Drilling fluid system 111 includes mud pumps, filter screens and other conventional mechanisms for mixing, filtering, and delivering drilling fluid through the drill pipe to the formation being drilled. The drilling fluid returns through the annulus surrounding the drillstring. The drilling fluid is necessary to cool and lubricate the drill bit, provides a means of removing the formation cuttings, and provides a fluid stabilizing column over the bottom and walls of the borehole being drilled to prevent or diminish the effects of a blowout.

A mud standpipe 113 and flexible conduit or hose 115 conduct drilling fluid from the drilling fluid system 111 to a top drive 117. Top drive 117 may be hydraulically or electrically driven and serves to lift and rotate the drillstring. Top drive 117 is coupled to a mast 119 of a rack-and-pinion design. The use of a top drive and rack-and-pinion system allows use of conventional rotary drilling techniques in the confined area and limited weight required for a minimum size of the drilling capsule 101. The mast 119 of the rack-and-pinion design is driven by multiple electric motors to reduce the power requirement of the drilling operation and increase the load handling of the rig racks.

According to the preferred embodiment of the present invention mast, 119 is approximately 78 feet tall and, accordingly, is dimensioned to handle two sections of conventional (30 foot) drill pipe 121. An umbilical flex hose bundle 123 is coupled to drilling capsule 101 and supplies breathable gas, electrical power, drilling fluid, and fresh water to drilling capsule 101 from surface 1. An umbilical flex hose bundle 123A returns the circulating mud, cuttings, and pressurized gas/breathing air to surface vessel 5. The air will be injected in the return mud line 123A to reduce the pumping horsepower required.

At the upper end of drilling capsule 101, a transport capsule 201 is connected to an aperture in drilling capsule 101 by a hatch assembly 203. Below hatch assembly 203 and contained within drilling capsule 101 is an upper BOP 205. Another BOP 207 is above hatch assembly 203 and is associated with transport capsule 201. As will be discussed in greater detail below, transport capsule 201 is a vessel pressurized with human-breathable gas and serves to transport human operators and equipment between drilling capsule 101 and the water's surface 1. Accordingly, pressurized transport capsule 201 typically has positive buoyancy, but the buoyancy of the transport capsule 201 can be adjusted to negative or neutral buoyancy by pump 201A.

At the lower end of drilling capsule 101, a guided legs template 301 is provided. Guided legs template 301 is a flat steel reinforced template with apertures or holes drilled appropriate for the equipment secured to template 301. This equipment includes a length of casing 303 (a relatively large diameter tubular member usually used to line or "case" a borehole after drilling but before production) and a plurality or four wire guideline posts 305 to which wire guidelines are attached that, optionally, can extend to the water's surface. Casing 303 may be up to 500 feet in length and extends from the lower central portion of template 301. As will be described later, casing 303 terminates at its lower end in a cementing shoe. A plurality of leveling legs 307 extend from the upper surface of template 301 to engage the lower surfaces of drilling capsule 101 to selectively level and maintain upright drilling capsule 101. Casing 303 is connected to drilling capsule by BOP stack 109 and hatch coupling 105.

With reference to FIG. 2, a transparent insulating cylinder 601 is installed around the BOP stack 109. Cylinder 601 will maintain a higher temperature around the BOP stack 109 due to the higher temperature of the returning circulating mud to prevent freezing of its pipes and quick couplings. The transparency of the cylinder 601 will allow an ROV (Remotely Operated Vehicle) to routinely examine the BOP stack 109, as required by regulation and common practice in deep water drilling. Cylinder 601 is attached to drilling capsule 101 in a manner to allow upward and downward sliding. The position of cylinder 601 with its sliding capability permits the ROV or divers to perform minor adjustments or repairs on the BOP 109. The capability to inject hot water/liquid into cylinder 601 inner diameter space when needed may be available.

USDR 11, according to the present invention, preferably includes an emergency personnel capsule 501, which is coupled through a capsule hatch 503 to a drilling control room 505 within capsule 101. The emergency personnel capsule 501 is pressurized and available for emergency evacuation of drilling capsule 101 by drilling personnel. Drilling control room 505 contains equipment for controlling and monitoring top drive 117 and drilling fluid system 111, among other operations of mast 119 and drilling operations in general. Duplicate drilling controls exist on the surface support vessel 5.

In the preferred embodiment, drilling capsule 101 contains an air heater, air dehumidifier, oxygen storage units, emergency power supply sources, and an air compressor to circulate the air from the drilling capsule 101 and inject same in the return mud line 123A. The injection of air in the return mud line 123A will reduce the pumping horsepower required to lift the return mud to the surface support vessel 5.

Figure 1A:
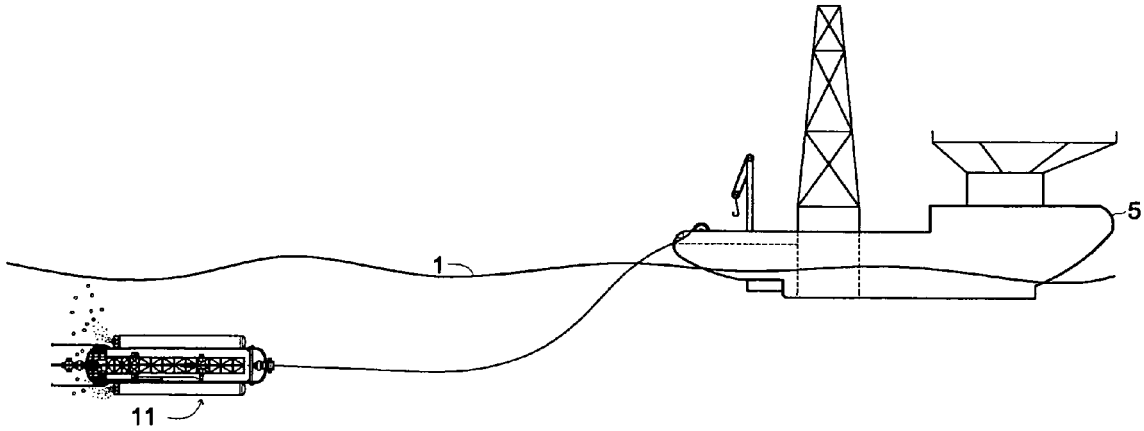
FIG. 1A shows the drilling capsule assembly in transport between drilling locations accompanied by a support vessel.
Figure 1A:
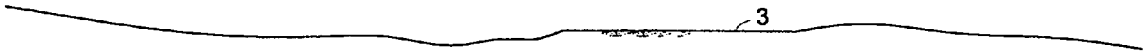

With reference now to all of the Figures, the operation of the USDR 11, according to the present invention, will be described. After a drilling site is selected, the support vessel 5 and the drilling capsule 101, with its two buoyancy capsules 103 and at least one closed BOP 109 attached to its bottom hatch 105, will move from one location to another location at the surface 1 or 10-20 feet below the surface to avoid strong waves, as illustrated in FIG. 1A. Drilling capsule 101 will move with its propeller and/or may have a self-propelled system or may be relocated with the assistance of another seagoing vessel.

Figure 1B:
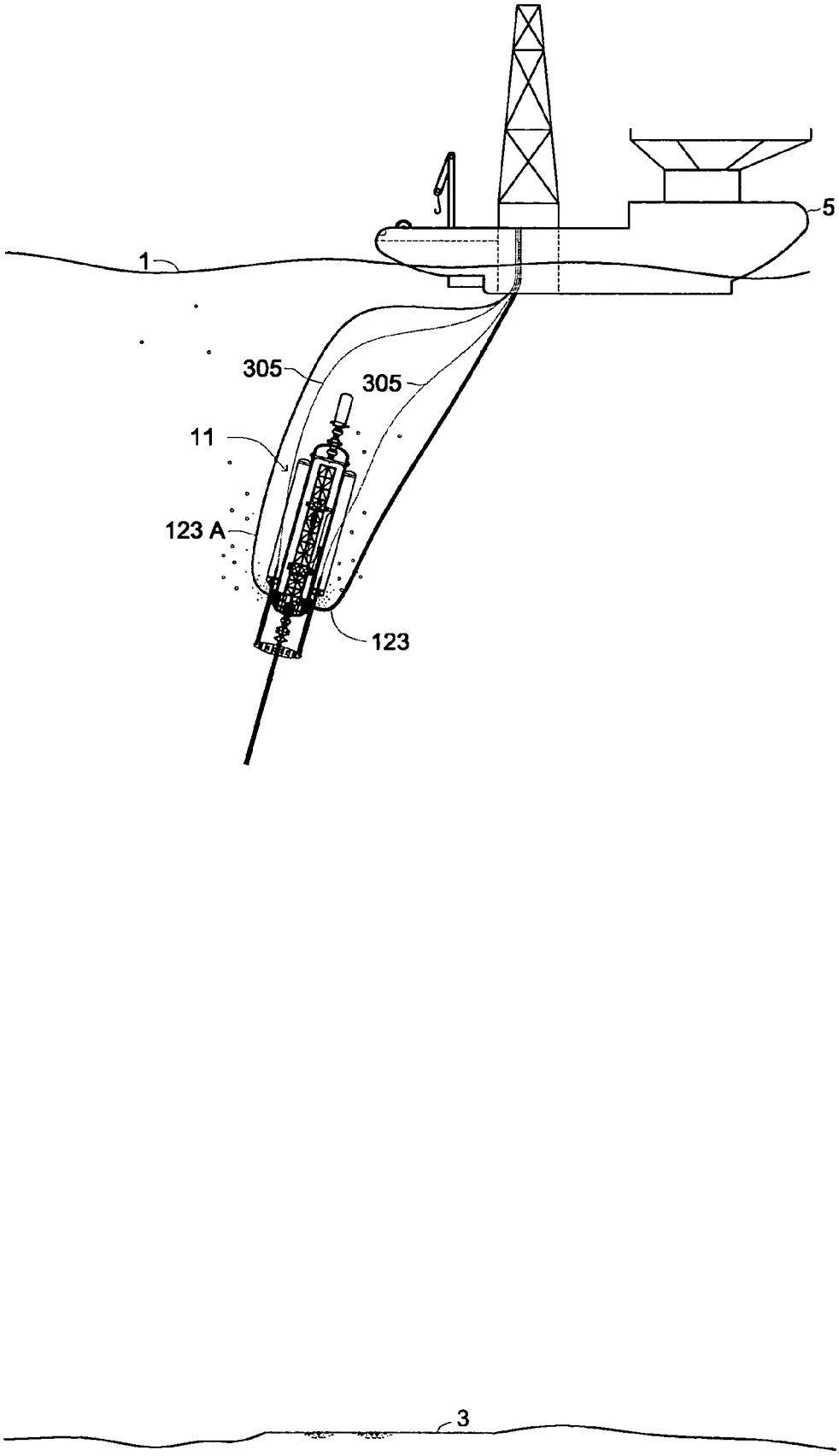
FIG. 1B illustrates the drilling capsule assembly changing from horizontal to vertical position for a controlled descent to the seafloor.
Figure 1C:
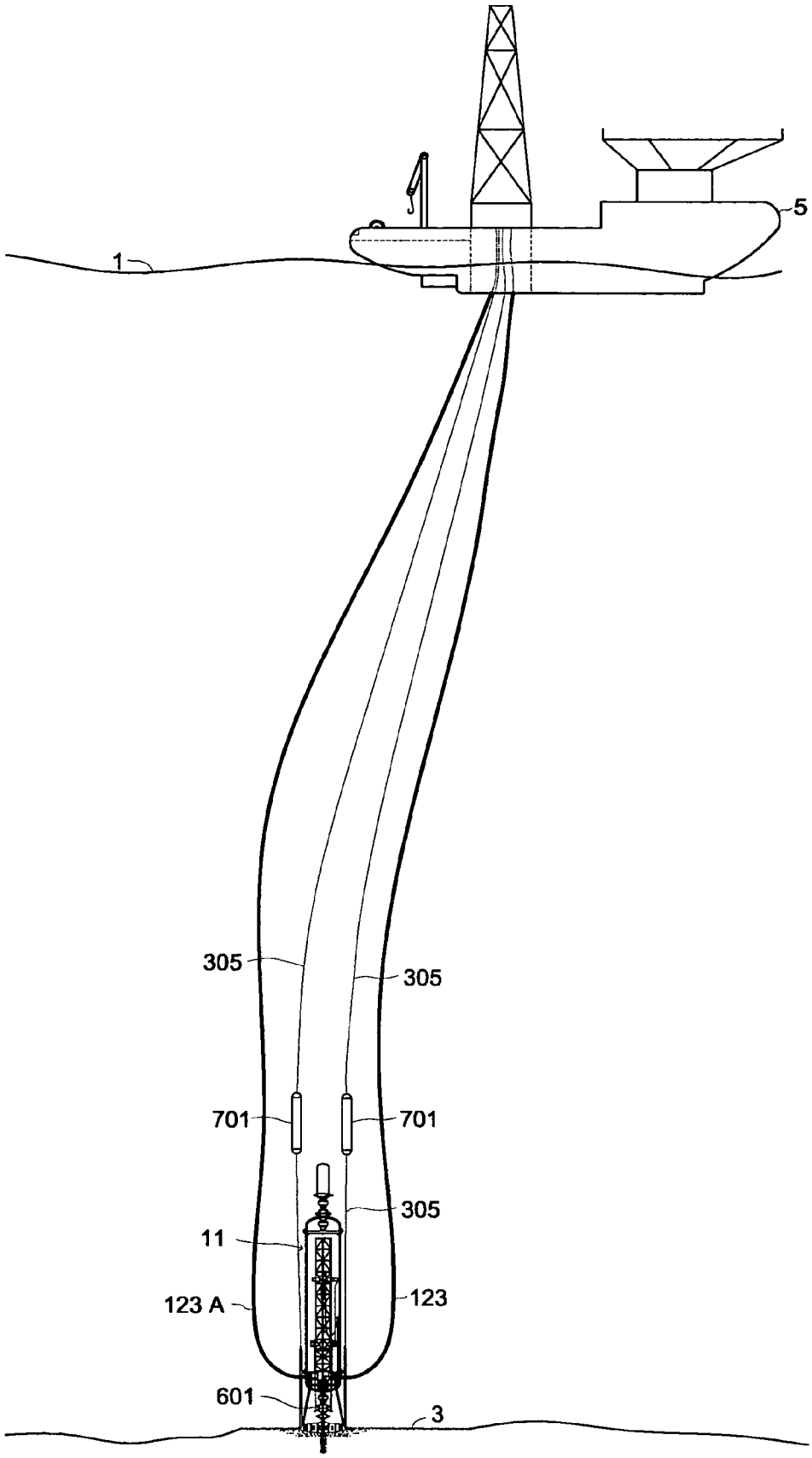
FIG. 1C shows the drilling capsule assembly securely positioned on the seafloor with the surface casing in the formation.

When drilling capsule 101 and support vessel 5 arrive at the designated location, the ballast water in the buoyancy capsules 103 of drilling capsule 101 are adjusted to bring the drilling capsule assembly to the surface. The balance of BOP stack 109 and large (20"-30") surface casing 303, with a drillstring assembly 121 inside template 301 and pipe and cable bundle 123 and 123*a*, are attached to the drilling capsule 101 (as illustrated in FIG. 1B).

Ballast water or other liquid is pumped into tanks in the lower end of drilling capsule 101, buoyancy capsules 103, and casing 303 based on a computer simulation program to bring the assembly to vertical position 20 to 50 feet below the sea surface to avoid wave action, which will generate stress. Continuous regulation of the ballast water generates a controlled descent of drilling capsule 101 to 800 to 900 feet from the seafloor 3. Drilling capsule 101 stops at this level and the attached side thrusters 103A are utilized to move the assembly laterally to the desired drilling location as guided by a plurality of three sonar beacons located at the seafloor 3.

During the descent of drilling capsule 101 from the surface 1 to the sea bottom 3, the fluid pressure between the inner and outer hulls of drilling capsule 101 is continuously regulated and adjusted. Preferably, the inner and outer hulls are subjected to a fluid pressure inversely proportional to their radius. At the bottom location, the fluid pressure between drilling capsule 101 inner and outer hulls will be further regulated to compensate for changes in fluid compressibility and temperature.

After positioning drilling capsule 101 at the desired drilling location, drilling capsule 101 will continue a slow descent until the surface casing shoe at the end of casing 303 is penetrated a few feet into the soft sea bottom (as shown in FIG. 2). At this time, the drilling crew descends to drilling capsule 101 by means of a transport capsule 201.

Figure 4:
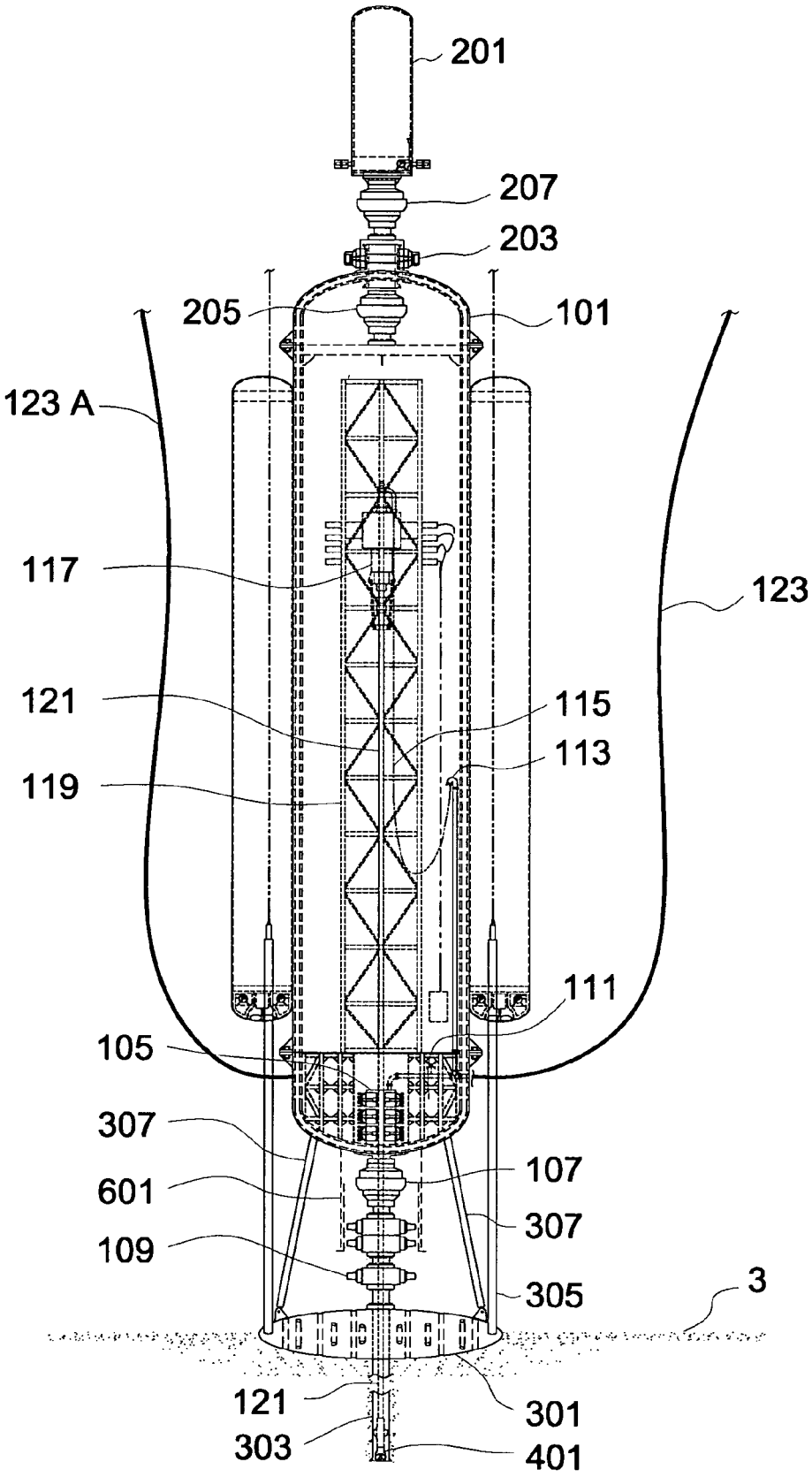
FIG. 4 illustrates the drilling capsule assembly spudding or boring into the seafloor to insert the surface casing tubular member.

Drillstring 121 will slide down through the continuous drilling fluid circulating system 111 and BOP 109 to drill the casing float plug and 6 to 8 feet of a larger hole than the casing outside diameter using an Enlarge While Drilling (EWD) tool 401 available from Tri-Max Industries, Inc. The ballast water in buoyancy and drilling capsules 101, 103 is then adjusted to generate 1000 to 3000 pounds of negative buoyancy in the drilling capsule 101. This will transfer 1000 to 3000 pounds of downward force to the surface casing 303. Seawater is continuously circulated around casing 303 and the attached thrusters 103A can be employed, if necessary, to generate slow clockwise rotation of drilling capsule 101 and casing 303 to facilitate the descent of the surface casing below the seafloor 3 until the depth of casing 303 is reached and template 301 rests on seafloor 3 (as shown in FIG. 4).

Figure 5:
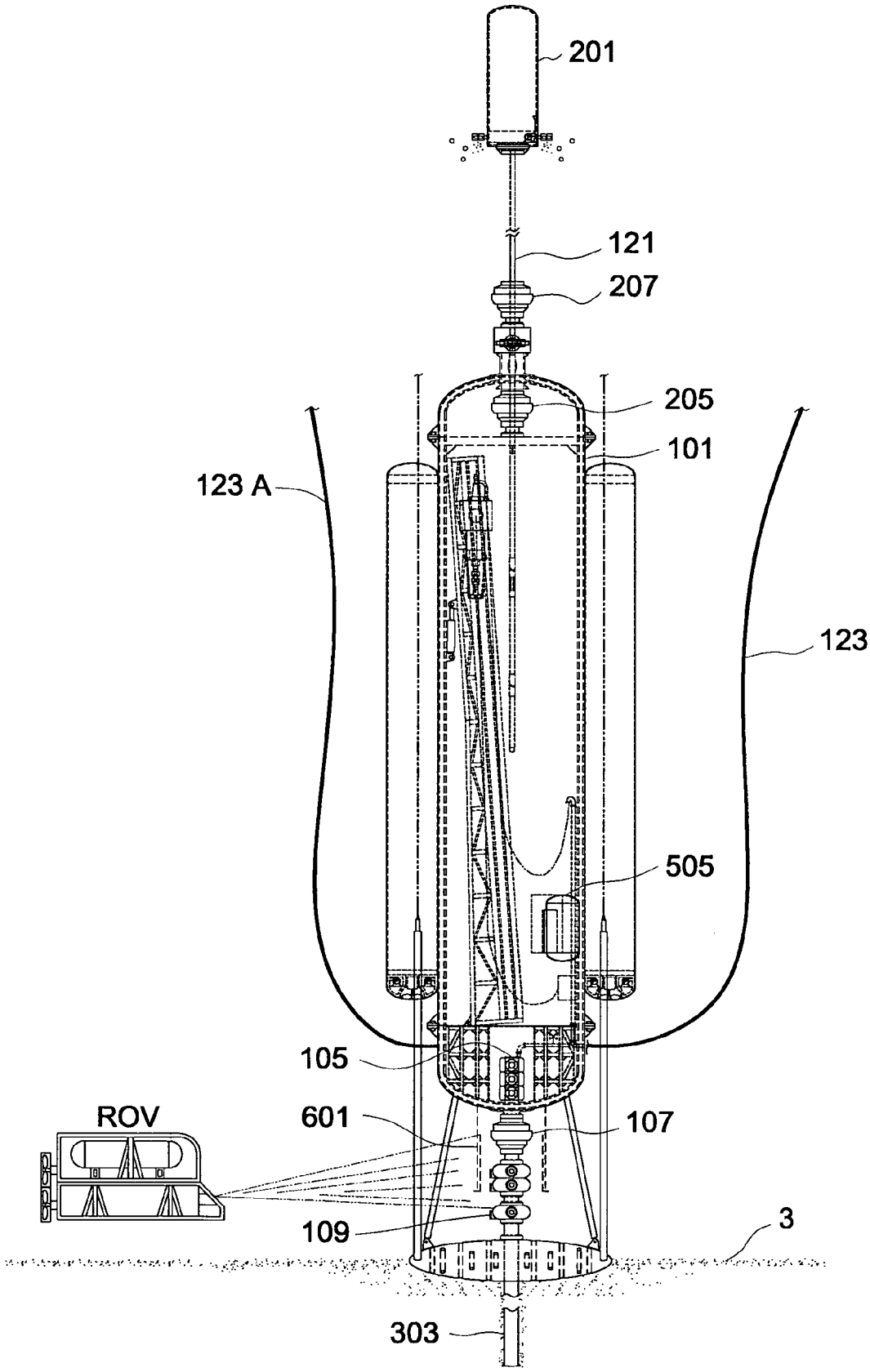
FIG. 5 depicts the drillstring being removed in a continuous length from the top opening of the drilling capsule.
Figure 6:
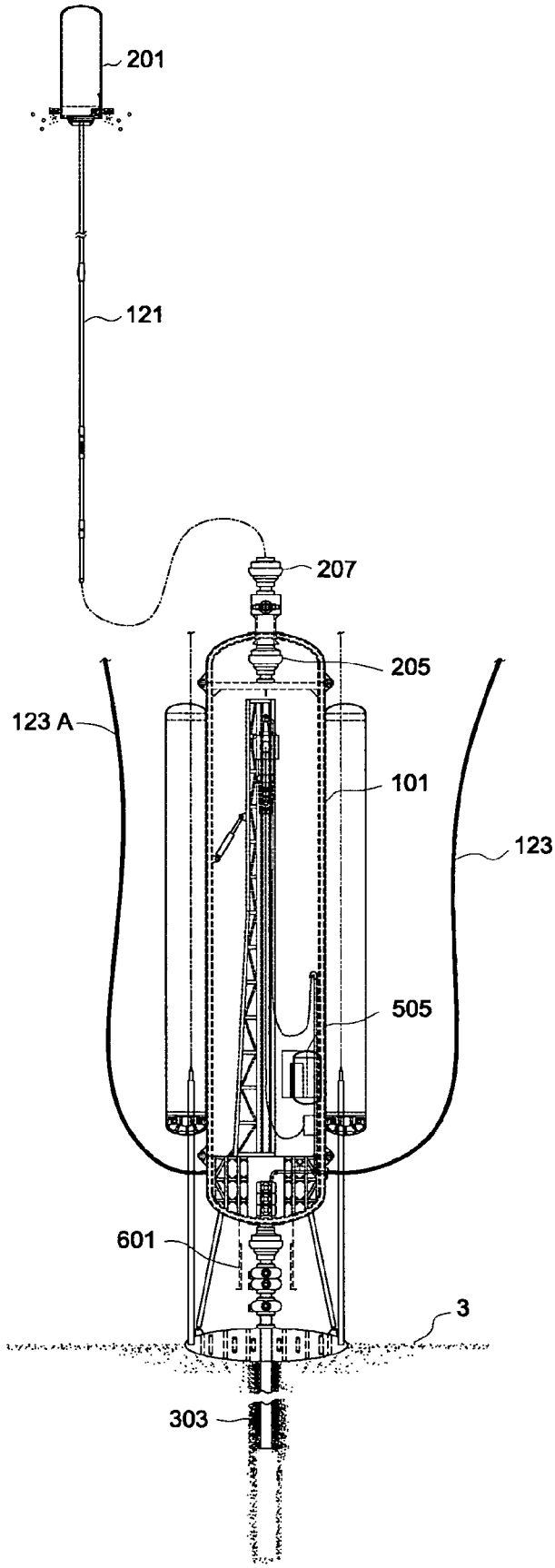
FIG. 6 illustrates the drillstring having exited the drilling capsule after drilling the hole section of the well.
Figure 7:
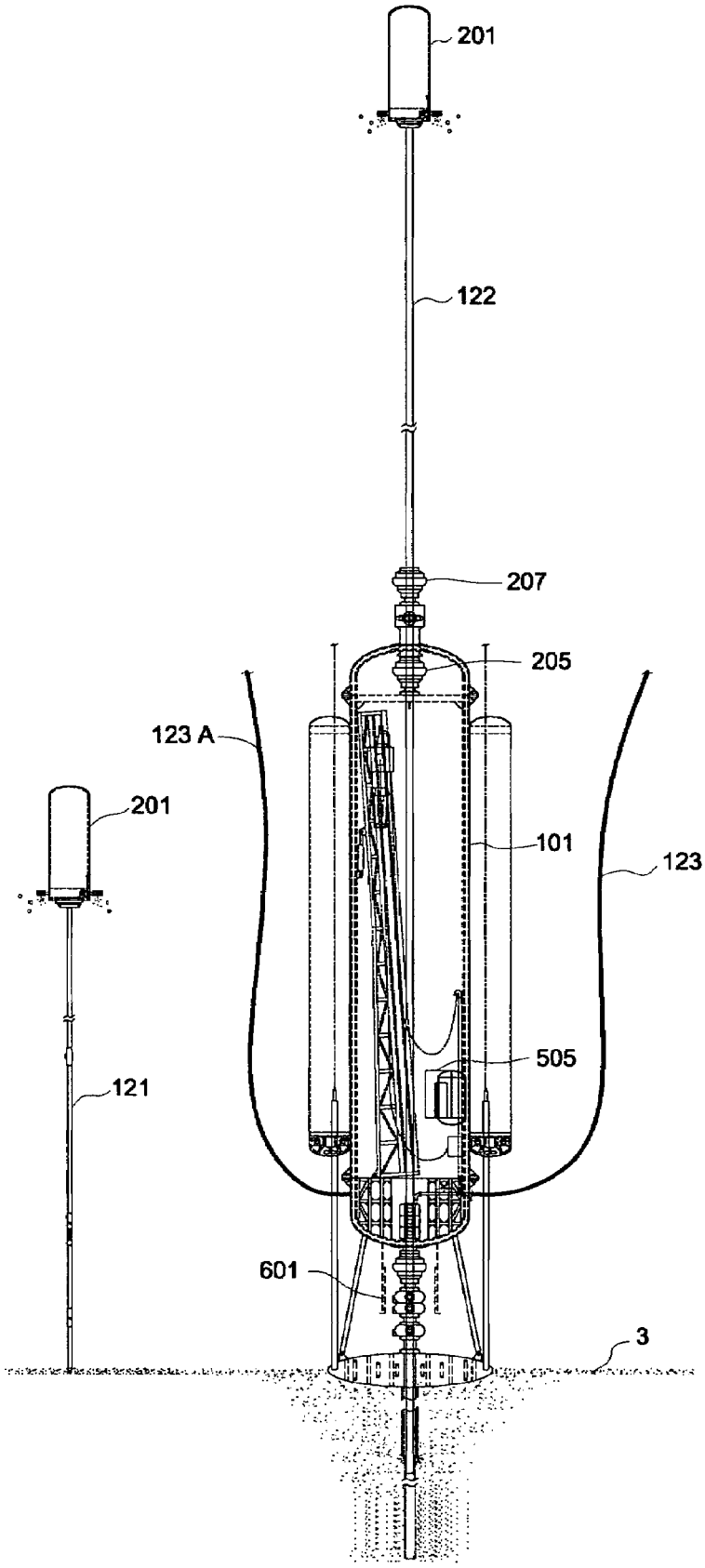
FIG. 7 illustrates the drillstring stored at the seafloor with the transport capsule in neutral buoyancy. A second string of casing is fed through the top opening of the drilling capsule to be seated and cemented in the well.

After monitoring the drill pipe pressure and the annulus pressure (the pressure between the inner diameter of casing 303 and outer diameter of the drill pipe), drillstring 121 is pulled into drilling capsule 101 and fed out through upper hatch 203 (FIG. 5). Transport capsule 201 is attached to the top of drillstring 121 and controls its upward movement relative to drilling capsule 101. Before 121 exits from drilling capsule 101, transport capsule 201 pumps water out of the bottom section of transport capsule 201 to generate a very small positive buoyancy. When 121 exits drilling capsule 101 completely (FIG. 6), transport capsule 201 pumps water into its lower section to generate a small negative buoyancy and drillstring 121 will rest a safe distance from drilling capsule 101 with its end penetrating a few feet into the soft seafloor (FIG. 7).

The EWD, bit and any stabilizers or special over-sized tools 401 are removed from drillstring 121 inside drilling capsule 101 by the drilling crew. The bottom of drillstring 121 is sealed before exiting drilling capsule 101 to assure its positive buoyancy.

A cementing head assembly is attached to casing 303. The casing cementing head has bottom and top cementing plugs inside it. Leveling legs 307 bring drilling capsule 101 to a vertical position. Casing 303 is cemented in place using cement and displacement fluid carried from the surface through conduit 123.

After cementing and waiting for the cement to set, drilling is ready to commence for the next section of the well. Another transport capsule 201 containing or carrying sections of drill pipe and the bit for the next interval, as well as logging and other tools, attaches to hatch 203 of drilling capsule 101. Once the tools are "offloaded" into drilling capsule 101, the casing cementing head and the first casing drilling tools are loaded into transport capsule 201 and transported to surface support vessel 5 via transport capsule 201.

The bit and logging tools then are made up into drillstring 121, transported back to drilling capsule 101 from its seafloor storage position, and rotary drilling is commenced using mast 119 and top drive 117. Additional sections of drill pipe, additional bits, and other drilling tools are supplied generally as described above by one or more transport capsules 201. Drilling personnel also can be added or removed from drilling capsule 101 in the same manner. Drilling can be monitored or controlled from the surface through signals duplicating the information in the drilling control room 505 at the surface support vessel 5 through conduit 123. The drilling personnel crew can rotate shifts every 12 hours to support vessel 5 via transport capsule 201.

When drilling is complete, drilling personnel attach a wellhead connector to casing 303 and drilling capsule 101 is detached from lower BOP stack 109, leaving template 301, casing 303, and all the casings and liners in place. Drilling capsule 101 then can be moved as described above for another drilling operation in another location. Another guided legs template 301 and associated equipment must be attached to drilling capsule 101 prior to commencement of drilling operations elsewhere. This may occur at or near the surface 1.

A significant benefit of the USDR system according to the present invention is that drilling and drilling fluids or mud circulation begin at seafloor 3, which permits a much larger range for the mud weight while drilling each interval. This is due to no longer having the weight of the column of mud in the riser that conventionally extends from the seafloor to the surface. The fluid column in the riser adds significant hydrostatic pressure on the borehole at the mud line (which is just below the seafloor), where no compaction of rock strength from the overburden exists. With seabed water temperatures as low as 30° F.; the riser also becomes a chilling chamber for drilling fluids. This hydrostatic pressure from the column of mud can be quite substantial. For example, in 8,000 feet of water depth, a 9.9 pound per gallon (ppg) mud will exert an additional 4,100 psi of hydrostatic pressure in the shallow section of a drilled hole. This starting baseline of hydrostatic head pressure results in multiple tubulars (casings or liners) needing to be run over short upper well intervals in order to stay between the pore pressure and overburden gradient. The USDR system allows the hole or well to be drilled in many cases with fewer tubular strings (casing, or liners), leading to substantial cost savings. Also, the range of mud weight which can be run in each interval would be increased (larger window for mud weight). This larger window would allow greater control of the pressures on the formation in the borehole, enabling a safer and more successful ability to stay above the pore pressure (minimum pressure required to prevent an influx of fluids from the formation) and below the overburden gradient (fluid pressure causing fracture of the formation and the beginning of a lost circulation situation which could lead to a well control event).

The invention is described with reference to a preferred embodiment(s) thereof. It is thus not limited, but is susceptible to variation and modification without departing from the scope and spirit of the invention.

I claim:

1. A subsea drilling system comprising:

a pressurized drilling capsule that is sealed against the subsea environment, the drilling capsule housing equipment for manipulating a drillstring that extends through an opening in the drilling capsule to the exterior of the capsule, the drilling capsule including an elongate pressure vessel having an opening at one end for connection to a pressurized transport unit, and an opening at an opposing end through which the drillstring passes;

a drilling fluid handling assembly contained within the drilling capsule, the drilling fluid handling assembly for communicating drilling fluid through the drillstring and returning drilling fluid to the water's surface via a drilling fluid conduit;

a seafloor unit for engaging the sea floor and the drilling capsule to position the drilling capsule relative to the seafloor, the seafloor unit including an opening for passing the drillstring into the sea floor;

the pressurized transport unit movable between the drilling capsule and a support vessel at or near the water's surface, the transport unit for delivering personnel and supplies to the drilling capsule; and a generally transparent and flexible cylindrical member extending from the opening at the opposing end of the drilling capsule to the seafloor unit, the cylindrical member enclosing and forming a passage therebetween.

2. The subsea drilling system according to claim 1, wherein the equipment for manipulating a drillstring includes a top drive mounted to a mast by a rack-and-pinion.

3. The subsea drilling system according to claim 1, wherein the seafloor unit comprises:

a generally flat guided legs template, the guided legs template having the opening and having wire guiding lines extending from the template to the water's surface;

a plurality of leveling legs extending upward from the template to engage a lower surface of the drilling capsule; and a tubular member extending from the opening in the guided legs template, the opening and tubular member cooperating to receive the drillstring guide it into the formation to be drilled.

4. The subsea drilling system according to claim 1 further comprising:

a plurality of buoyancy capsules secured to the drilling capsule, the buoyancy capsules having adjustable buoyancy, wherein the drilling capsule can selectively float, sink, or have neutral buoyancy.

5. The subsea drilling system according to claim 1 further comprising a pressurized emergency personnel capsule associated with the drilling capsule to permit human personnel to exit the drilling capsule in an emergency.

6. The subsea drilling system according to claim 1, wherein the drilling capsule is of sufficient length to handle at least one section of conventional, 30-foot drill pipe.

7. The subsea drilling system according to claim 1, wherein the drilling capsule is a pressure vessel of double-wall construction having an inner and an outer wall, a space between the inner and outer walls being selectively pressurized.

8. A subsea drilling system comprising:

a drilling capsule that is sealed against the subsea environment, the drilling capsule housing equipment for manipulating a drillstring that extends through an opening in the drilling capsule to the exterior of the capsule, the drilling capsule having inner and outer walls, wherein a space between the inner and outer walls is selectively pressurized, the drilling capsule including an elongate pressure vessel having an opening at one end for connection to a pressurized transport unit and an opening at an opposing end through which the drillstring passes;

a drilling fluid handling assembly contained within the drilling capsule, the drilling fluid handling assembly for communicating drilling fluid through the drillstring and returning drilling fluid to the water's surface via a drilling fluid conduit;

a seafloor unit for engaging the sea floor and the drilling capsule to position the drilling capsule relative to the seafloor, the seafloor unit including an opening for passing the drillstring into the sea floor;

the pressurized transport unit movable between the drilling capsule and a support vessel at or near the water's surface, the transport unit for delivering personnel and supplies to the drilling capsule and a generally transparent and flexible cylindrical member extending from the opening at the opposing end of the drilling capsule to the seafloor unit, the cylindrical member enclosing and forming a passage therebetween.

9. The subsea drilling system according to claim 8, wherein the equipment for manipulating a drillstring includes a top drive mounted to a mast by a rack-and-pinion.

10. The subsea drilling system according to claim 8, wherein the seafloor unit comprises:

a generally flat guided legs template, the guided legs template having the opening and having wire guiding lines extending from the template to the water's surface;

a plurality of leveling legs extending upward from the template to engage a lower surface of the drilling capsule; and a tubular member extending from the opening in the guided legs template, the opening and tubular member cooperating to receive the drillstring guide it into the formation to be drilled.

11. The subsea drilling system according to claim 8 further comprising:

a plurality of buoyancy capsules secured to the drilling capsule, the buoyancy capsules having adjustable buoyancy, wherein the drilling capsule can selectively float, sink, or have neutral buoyancy.

12. The subsea drilling system according to claim 8 further comprising a pressurized emergency personnel capsule associated with the drilling capsule to permit human personnel to exit the drilling capsule in an emergency.

13. The subsea drilling system according to claim 8, wherein the drilling capsule is of sufficient length to handle at least one section of conventional, 30-foot drill pipe.

14. A subsea drilling system comprising:

a pressurized drilling capsule that is sealed against the subsea environment, the drilling capsule housing equipment for manipulating a drillstring that extends through an opening in the drilling capsule to the exterior of the capsule, the drilling capsule including an elongate pressure vessel having an opening at one end for connection to a pressurized transport unit, and an opening at an opposing end through which the drillstring passes, the drilling capsule being long enough to handle at least one length of conventional, 30-foot drill pipe;

a drilling fluid handling assembly contained within the drilling capsule, the drilling fluid handling assembly for communicating drilling fluid through the drillstring and returning drilling fluid to the water's surface via a drilling fluid conduit;

a seafloor unit for engaging the sea floor and the drilling capsule to position the drilling capsule relative to the seafloor, the seafloor unit including an opening for passing the drillstring into the sea floor;

the pressurized transport unit movable between the drilling capsule and a support vessel at or near the water's surface, the transport unit for delivering personnel and supplies to the drilling capsule; and a generally transparent and flexible cylindrical member extending from the opening at the opposing end of the drilling capsule to the seafloor unit, the cylindrical member enclosing and forming a passage therebetween.

15. The subsea drilling system according to claim 14, wherein the equipment for manipulating a drillstring includes a top drive mounted to a mast by a rack-and-pinion.

16. The subsea drilling system according to claim 14, wherein the seafloor unit comprises:

a generally flat guided legs template, the guided legs template having the opening and having wire guiding lines extending from the template to the water's surface;

a plurality of leveling legs extending upward from the template to engage a lower surface of the drilling capsule; and a tubular member extending from the opening in the guided legs template, the opening and tubular member cooperating to receive the drillstring guide it into the formation to be drilled.

17. The subsea drilling system according to claim 14 further comprising:

a plurality of buoyancy capsules secured to the drilling capsule, the buoyancy capsules having adjustable buoyancy, wherein the drilling capsule can selectively float, sink, or have neutral buoyancy.

18. The subsea drilling system according to claim 14 further comprising a pressurized emergency personnel capsule associated with the drilling capsule to permit human personnel to exit the drilling capsule in an emergency.

19. The subsea drilling system according to claim 14, wherein the drilling capsule is a pressure vessel of double-wall construction having an inner and an outer wall, a space between the inner and outer walls being selectively pressurized.

20. A method of drilling a formation submerged in water, the method comprising the steps of:

pressurizing a drilling capsule assembly and maintaining the drilling capsule assembly in a pressurized state suitable for human occupancy;

submerging the drilling capsule assembly by altering its buoyancy;

attaching a generally transparent and flexible cylindrical member extending from the opening at the opposing end of the drilling capsule to the seafloor unit, the cylindrical member enclosing and forming a passage therebetween;

securing the drilling capsule assembly to the formation by drilling a pilot hole in the formation from within the drilling capsule assembly and inserting a portion of the drilling capsule assembly into the pilot hole;

delivering a drillstring to the drilling capsule assembly, the drillstring including at least one length of 30-foot drill-pipe; and assembling a bottomhole assembly into the drillstring;

rotating the drillstring from within the drilling capsule to bore a hole in the formation; and selectively removing the drillstring from the hole and the drilling capsule assembly, wherein the drillstring remains assembled and includes at least one length of 30-foot drill pipe.

21. The method according to claim 20, further comprising the step of:

assembling at least one section of 30-foot drill pipe into the drillstring within the drilling capsule assembly.

* * * * *